United States Patent [19]

Credle, Jr.

[11] Patent Number: 4,590,975

[45] Date of Patent: May 27, 1986

[54] AUTOMATIC BEVERAGE DISPENSING SYSTEM

[75] Inventor: William S. Credle, Jr., Stone Mountain, Ga.

[73] Assignee: The Coca-Cola Company, Atlanta, Ga.

[21] Appl. No.: 620,192

[22] Filed: Jun. 13, 1984

[51] Int. Cl.[4] ..... B65B 3/04

[52] U.S. Cl. ..... 141/1; 141/84; 141/174

[58] Field of Search ..... 141/129–191, 141/84, 1–12, 94, 95, 198

[56] References Cited

U.S. PATENT DOCUMENTS

| | | | |
|---|---|---|---|
| 2,580,257 | 4/1946 | Tacchella | 141/174 |
| 2,878,968 | 7/1955 | Burgoyne | 222/129.1 |
| 2,953,171 | 4/1958 | Arnett et al. | 141/174 |
| 3,142,267 | 4/1961 | Shofer | 141/174 |
| 3,298,565 | 12/1963 | Cease | 221/13 |
| 3,364,959 | 12/1965 | Herman et al. | 141/155 |
| 3,530,907 | 12/1967 | Slass | 141/174 |
| 3,951,303 | 9/1973 | Hobden et al. | 221/96 |
| 4,102,660 | 8/1976 | Beckett et al. | 62/344 |
| 4,174,742 | 11/1979 | Murphey et al. | 141/174 |
| 4,198,831 | 1/1978 | Barnard | 62/320 |
| 4,226,269 | 12/1978 | Carr et al. | 222/361 |
| 4,228,923 | 8/1979 | Barnard | 222/52 |
| 4,241,847 | 12/1978 | Lancia et al. | 221/12 |
| 4,319,441 | 11/1980 | Credle | 53/131 |

*Primary Examiner*—Houston S. Bell, Jr.

[57] ABSTRACT

A narrow, modular automatic beverage dispensing assembly to be attached to an existing ice dispensing beverage dispenser, to provide automatic beverage dispensing capability. The modular assembly includes two separate subassemblies; the first subassembly includes an automatic cup dropper, and the second subassembly includes an automatic beverage dispensing means and an automatic conveyor. The existing beverage dispenser to which the modular assembly of this invention is attached is modified by adding thereto an automatic ice dispenser that feeds ice into the attached modular assembly.

31 Claims, 18 Drawing Figures

AUTOMATIC BEVERAGE DISPENSING SYSTEM

BACKGROUND OF THE INVENTION

1. Field of the Invention

This invention relates to beverage dispensers and in particular to a modular automatic beverage dispensing assembly that can be added to an existing beverage dispenser.

2. Description of the Prior Art

Various techniques have been proposed for providing automated systems for dispensing soft drinks such as the utilization of conveyor type systems whereby cups are automatically introduced to a continuously moving conveyor which receives the cups and processes them forward through a cup filling station, a cup capping station and a cup discharge station. The cup filling means travels forward synchronously with the conveyor belt while filling the cups and a heat sealing device is provided whereby caps are heat sealed to the rims of the cups while traveling forward. A discharge station is provided for automatically lifting and transferring the cups. Other techniques provide elaborate approaches for fulfilling each phase of a drink dispensing system such as at the ice dispensing station, the cap dispensing and sealing station or the beverage dispensing station, but these approaches have the overall disadvantage of being too large and/or expensive for utilization as a self-contained, compact post-mix drink dispensing system.

It is an object of the present invention to provide an inexpensive and easy way to add automatic beverage dispensing capability to an ice-dispensing beverage dispenser.

It is another object of this invention to provide a narrow, modular, automatic beverage dispensing assembly for attachment to an ice dispenser.

It is a further object of this invention to provide such a modular assembly with two separate subassemblies to provide greater flexibility in installing and interfacing with an existing beverage dispenser.

It is another object of the invention to provide such a modular assembly with a compact, safe conveyor.

It is another object to provide an improved automatic ice dispenser.

SUMMARY OF THE INVENTION

An automatic beverage dispensing apparatus comprising a modular assembly, composed of two subassemblies, for attachment to an existing beverage dispenser of the type having an ice dispenser. The modular assembly includes an automatic cup dropper, an automatic beverage dispenser, and an automatic conveyor. The existing beverage dispenser is modified to add an ice chute extending from a side wall thereof, and means for automatically dispensing different predetermined quantities of ice from the additional ice chute. The modular assembly has an opening in a vertical side wall of the cup chute to receive and to accommodate the discharge end of such additional ice chute, when the modular assembly is connected to the side wall of the existing beverage dispenser.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENTS

Figure 1:
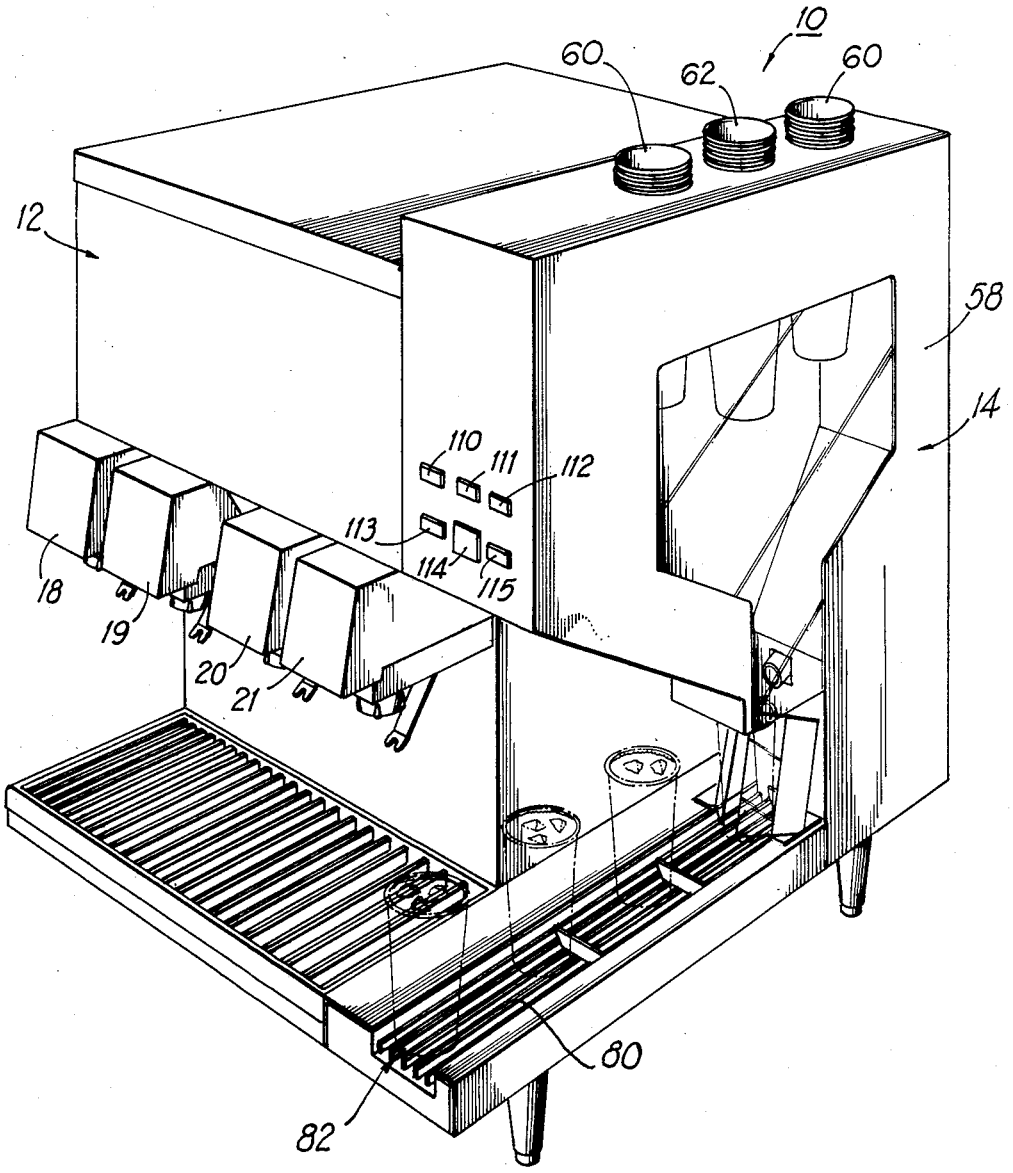
FIG. 1 is a perspective view of the narrow modular assembly of the present invention attached to an ice dispensing beverage dispenser.
Figure 2:
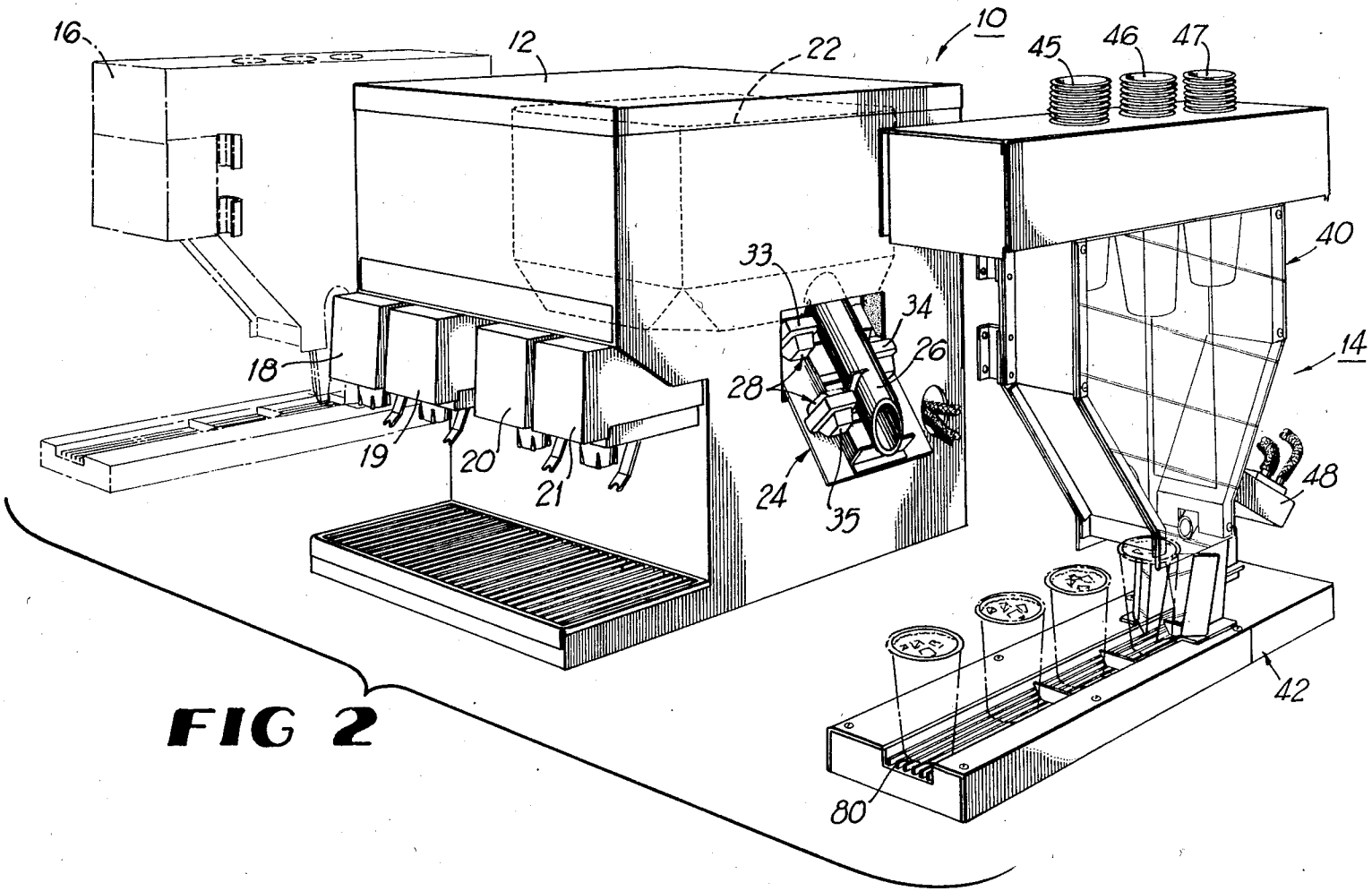
FIG. 2 is an exploded perspective view similar to FIG. 1.

With reference now to the drawings, FIGS. 1 and 2 show an automatic beverage dispensing apparatus 10 according to the preferred embodiment of the present invention. The apparatus 10 includes a standard, well-known ice dispensing beverage dispenser 12, modified as will be discussed below, in combination with a narrow, modular automatic beverage dispensing assembly 14 according to the present invention, that attaches to the right side of the dispenser 12. As shown in phantom lines in FIG. 2, a second modular assembly 16 can also be attached to the dispenser 12 on its left side, if desired.

The dispenser 12 can be any one of a number of well-known dispensers having a plurality of beverage dispensing valve assemblies 18, 19, 20, and 21 and an ice dispenser. The ice dispenser includes a standard ice compartment 22 (see FIG. 2) and a standard manual ice dispensing chute (not shown) located between the valve assemblies 19 and 20.

With reference to FIGS. 2–4 and 9–13, the dispenser 12 is modified by adding thereto, on the right side thereof, an automatic ice dispenser 24. The ice dispenser 24 can be any standard, well-known type including an ice chute 26, and an automatic ice dispensing mechanism 28 for dispensing different predetermined quantities of ice, such as for small and large size cups.

Figure 10:
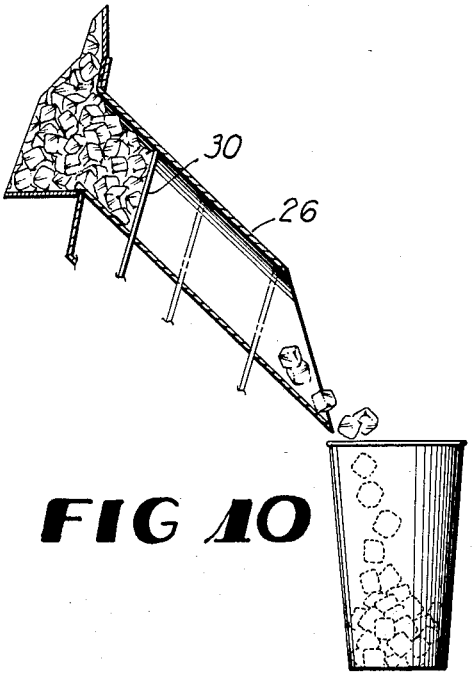
FIGS. 9–11 are partly cross-sectional, elevational views through the ice chute showing the operation thereof.
Figure 9:
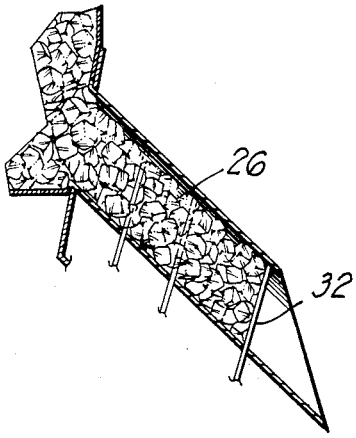
Figure 11:
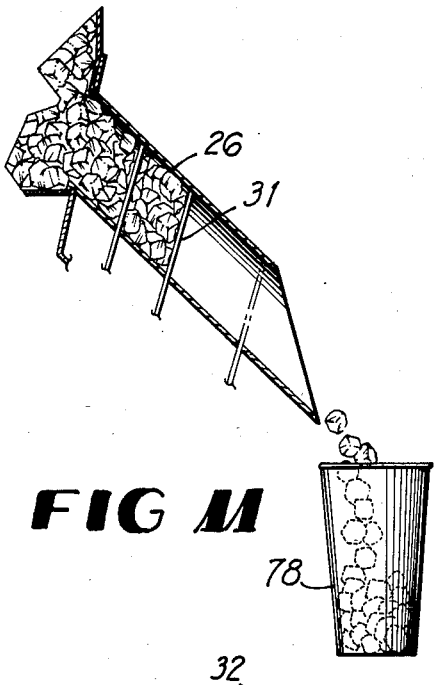

The mechanism 28 can be any standard, well-known mechanism (see U.S. Pat. Nos. 4,226,269 and 4,386,640, for example, incorporated herein by reference) including, for example, three removable stop members 30, 31 and 32, operated by three solenoids 33, 34 and 35, respectively. FIG. 9 shows the normal or start condition of the mechanism 28 with stop member 32 inserted in the ice chute 26 and with stop members 30 and 31 retracted from the ice chute. The solenoids 33, 34 and 35 are unenergized in this condition. To fill a large cup, the stop member 30 is inserted and then the stop member 32 is withdrawn, as shown in FIG. 10, thus dispensing a full amount of ice into a large size cup.

Figure 12:
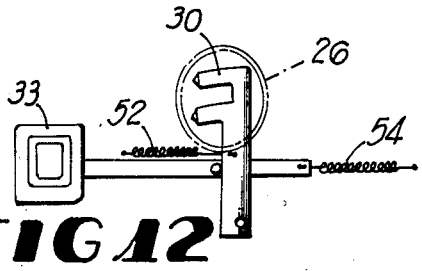
FIGS. 12 and 13 are elevational views of the two ice chute stop members.

Similarly, for a small size cup, starting with the condition shown in FIG. 9, the stop member 31 is inserted and then stop member 32 is withdrawn, as shown in FIG. 12, thus dispensing a small quantity of ice into a small cup. The modular assembly 14 employs only two cup sizes, small and large, however, other sizes and other numbers of sizes such as small, medium and large can be used, if desired.

Figure 13:
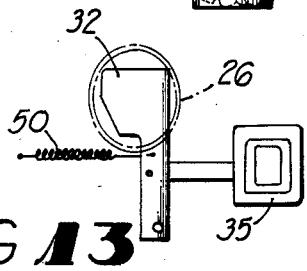

The operation of the stop members is shown in FIGS. 12 and 13. The stop member 32 is held inserted by a spring 50 and is retracted by the solenoid 35. The two stop members 30 and 31 operate differently from the stop member 32. Because the two stop members 30 and 31 both operate the same way, a description of the operation of only one of the stop members 30 and 32 will be described. With reference to FIG. 12, the spring 54 is stronger than the spring 52 and thus the stop member 30 is held retracted in its normal condition when the solenoid 33 is unenergized. To insert the stop member 30 into the ice chute 26, the solenoid 33 is energized, and it is stronger than the spring 54. Thus, the spring 52 is now allowed to insert the stop member 30 into the ice chute.

The modular assembly 14 of the present invention will now be described. The assembly 14 is composed of a first subassembly 40 and a separate, second subassembly 42. The first subassembly 40 includes an automatic cup dropper 44. The second subassembly 42 includes an automatic beverage dispensing valve assembly 48 and an automatic conveyor 56.

The two subassemblies 40 and 42 are separately attached to the side of the beverage dispenser 12 and are then covered by a shroud or cover 58. The front face of the cover 58 of the modular assembly 14 includes a top row of three indicator lights 110, 111, and 112 that indicate when the first, second, and third stacks 45, 46 and 47, of cups, respectively, is empty and needs refilling; each light is connected to a respective cup sensing switch in each cup stack. The front face of the cover 58 also includes a second row of one light 113 and two buttons 114 and 115. The light 113 simply informs the operator that the assembly 14 is on. The button 114 is an emergency stop. The button 115 is a brix button which causes only beverage to be dispensed and which prevents the ice dispenser and the conveyor from operating. The brix of the product can then be measured according to standard procedures.

The use of two separate subassemblies provides flexibility in installing and interfacing the modular assembly 14 with different beverage dispensers 12. For example, different dispensers have different sizes and because the two subassemblies are not attached to each, they can easily be attached to a dispenser at the desired location, whereas this would not always be possible if they were fixed relative to each other. Further, one of the components such as the conveyor, can be changed without requiring any change in the remainder of the assembly.

The cup dropper 44 can use any one of a number of well-known cup holding and cup dropping mechanisms 59 such as shown in U.S. Pat. Nos. 4,319,441 and 3,951,303, incorporated herein by reference. The preferred embodiment shown in the drawings uses only small cups 60 and large cups 62; however, other arrangements such as small, medium, and large cups can be used. A solenoid device 64 is used to dispense one cup at a time, as is well-known in this art. The cup dropper 44 also includes a cup chute 66 that guides the dropped cup onto the conveyor 56 at the cup dropping station 67. The cup chute includes at least one vertical wall having an opening 68 for receiving the distal end of the ice chute 26.

The automatic beverage dispensing valve assembly 48 includes a valve assembly 70 mounted on a lower portion of the cup chute 66. The beverage dispenser 12 is also modified to have a carbonated water line 72 and a syrup line 74 extend from the sidewall thereof to the valve assembly 70.

The valve assembly 70 can be any well-known type of valve assembly. The valve assembly shown is for dispensing a single flavor; however, a multi-flavor valve assembly can alternatively be used. The nozzle 76 of the valve assembly 70 extends out over the edge of a cup 78 in the cup dropping station, just inside of the wall of the cup chute.

The automatic conveyor 56 of the second subassembly will now be described. Although any well-known conveyor can be used, such as that shown in U.S. Pat. No. 2,580,257, for example, the preferred conveyor described below has the advantages of being compact and safe. While the conveyor as shown terminates at an operator station 82, a second conveyor can be located adjacent the front end of conveyor 56 to receive filled cups therefrom, so that the modular assembly will not stop operating when four cups are present on the conveyor surface 80. The particular conveyor 56 of the present invention also provides the capability of positively pushing filled cups onto such an additional conveyor (not shown).

The conveyor 56 includes a flat, narrow, horizontal cup supporting surface 80 adjacent the lower portion of the assembly 14 and extending from the cup dropping station 67 to an operator station 82. The surface 80 is stationary and the cups are moved by a shuttle arrangement including a plurality of equally spaced-apart transverse push arms connected to a reciprocatable rod 86. The push arms are retractable during the return stroke of the shuttle arrangement by means of the rod 86 being mounted for turning movement about its longitudinal axis. A cam follower 88 is connected to the rod 86 and is located adjacent to a cam 90.

Figure 5A:
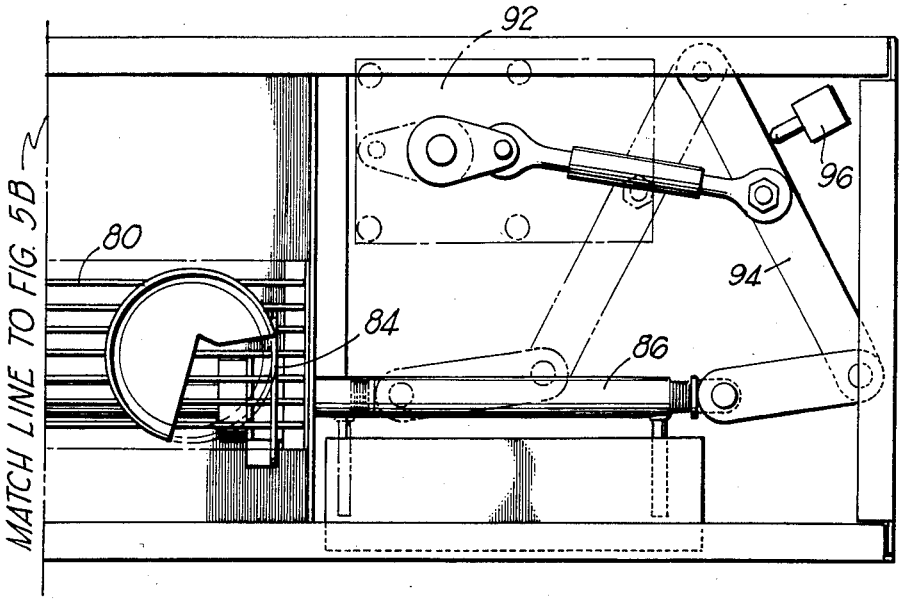
FIGS. 5A and 5B are plan views of the conveyor.
Figure 5B:
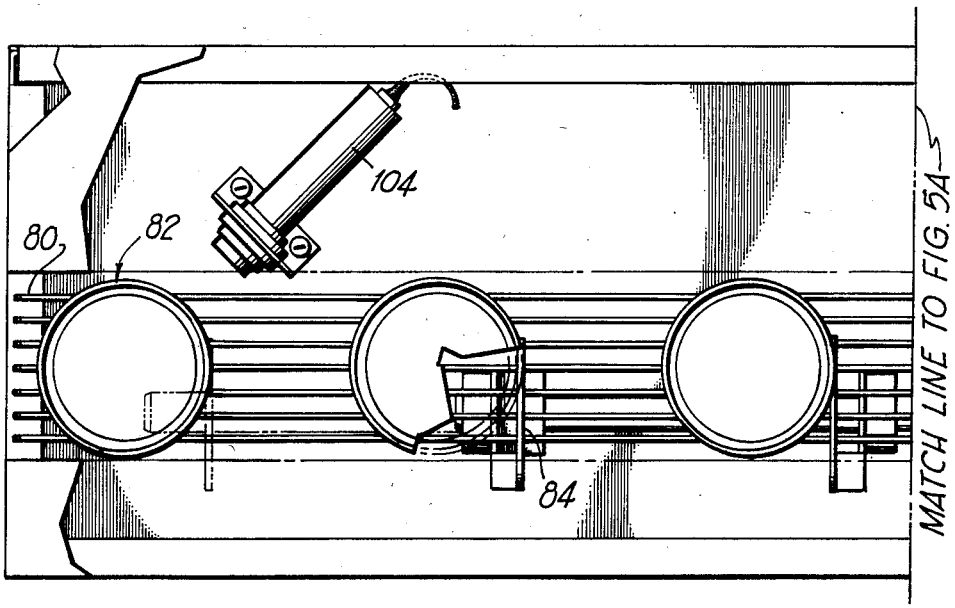
Figures 6, 7, 8:
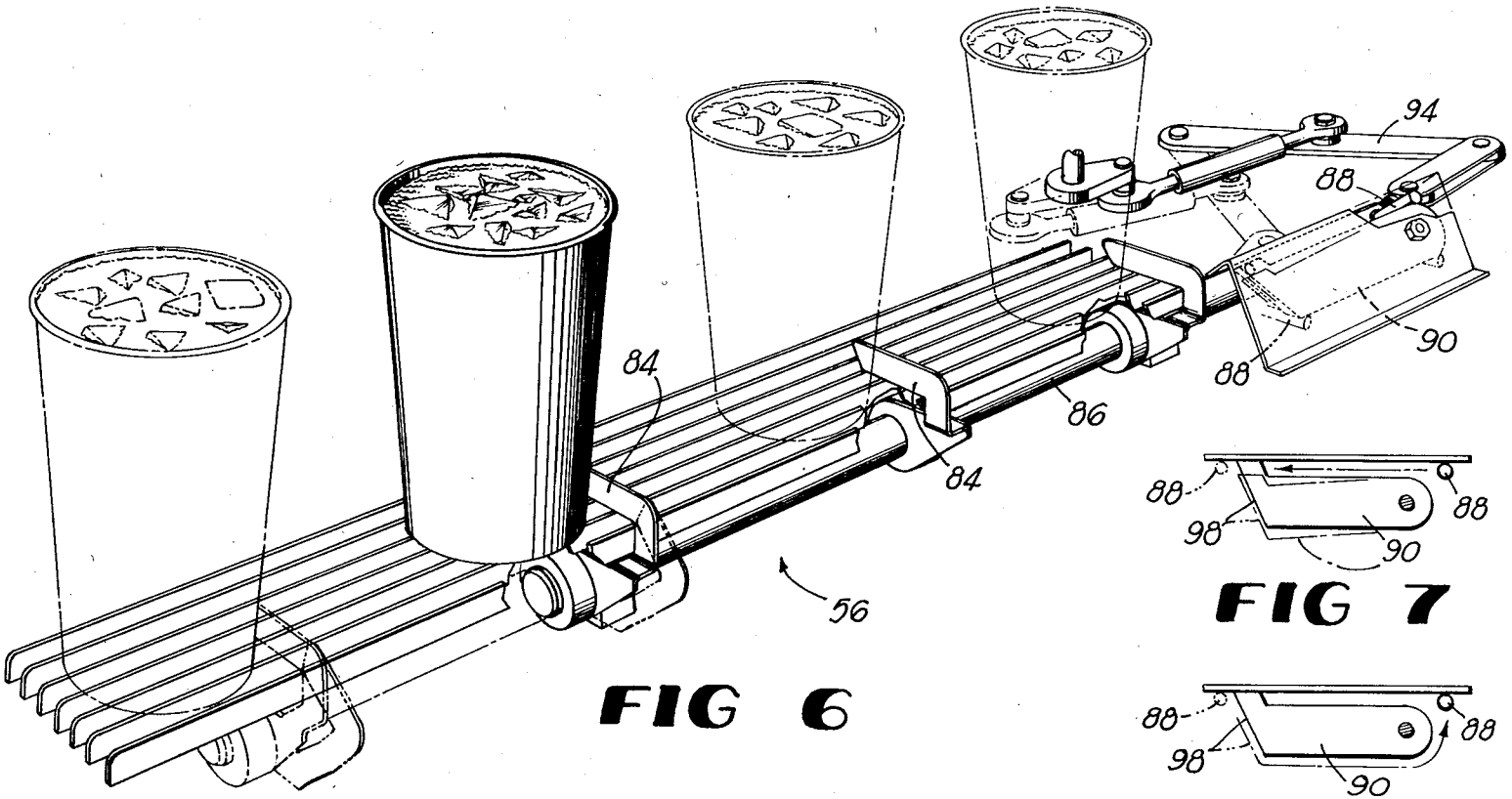
FIG. 6 is a perspective view of the conveyor.
FIGS. 7 and 8 are diagrammatic views showing the operation of the camming action of the conveyor.

The back and forth movement of the rod 86 is controlled by a gear motor 92, connected to the rod 86 by a lever mechanism 94 as shown in FIGS. 5A and 6. A switch 96 is located as shown in FIG. 5A adjacent to the lever mechanism 94 to turn off the gear motor 92 at the end of one rotation, which produces one back and forth cycle of the rod 86 and push arms 84.

The push arms 84 push the cups forward on the forward stroke and are retracted away from the surface 80 during the return stroke by means of the cam-cam follower arrangement of FIGS. 6, 7 and 8. The cam 90 pivots down as shown in FIG. 7 during the forward stroke and then snaps back in place, by a spring bias, so that during the return stroke, the cam follower 88 hits the cam surface 98 and causes the rod 86 to rotate which retracts the push arms away from the surface 80.

Figure 3:
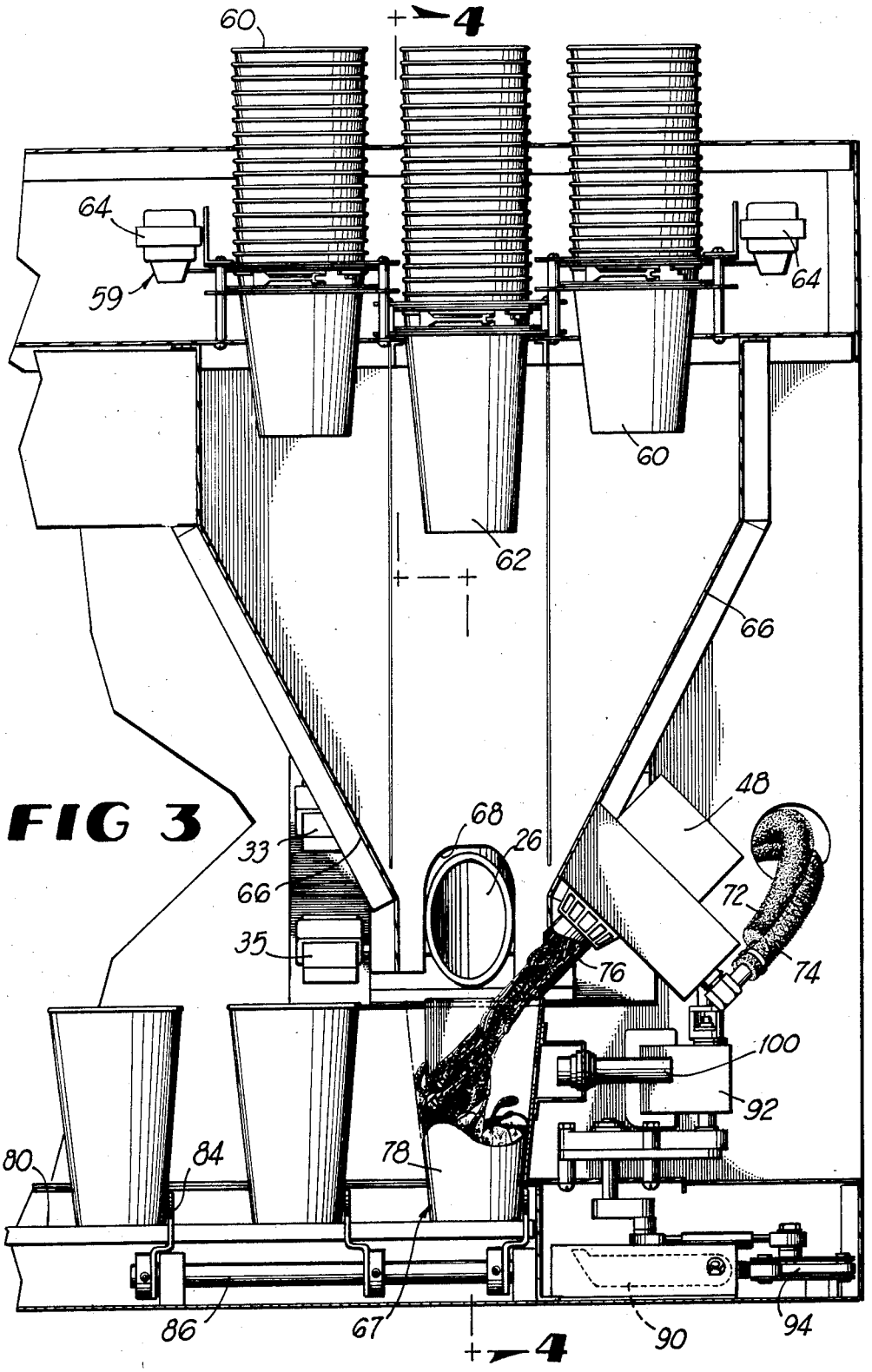
FIG. 3 is a partly cross-sectional, partial elevational view through the modular assembly of FIG. 1.
Figure 4:
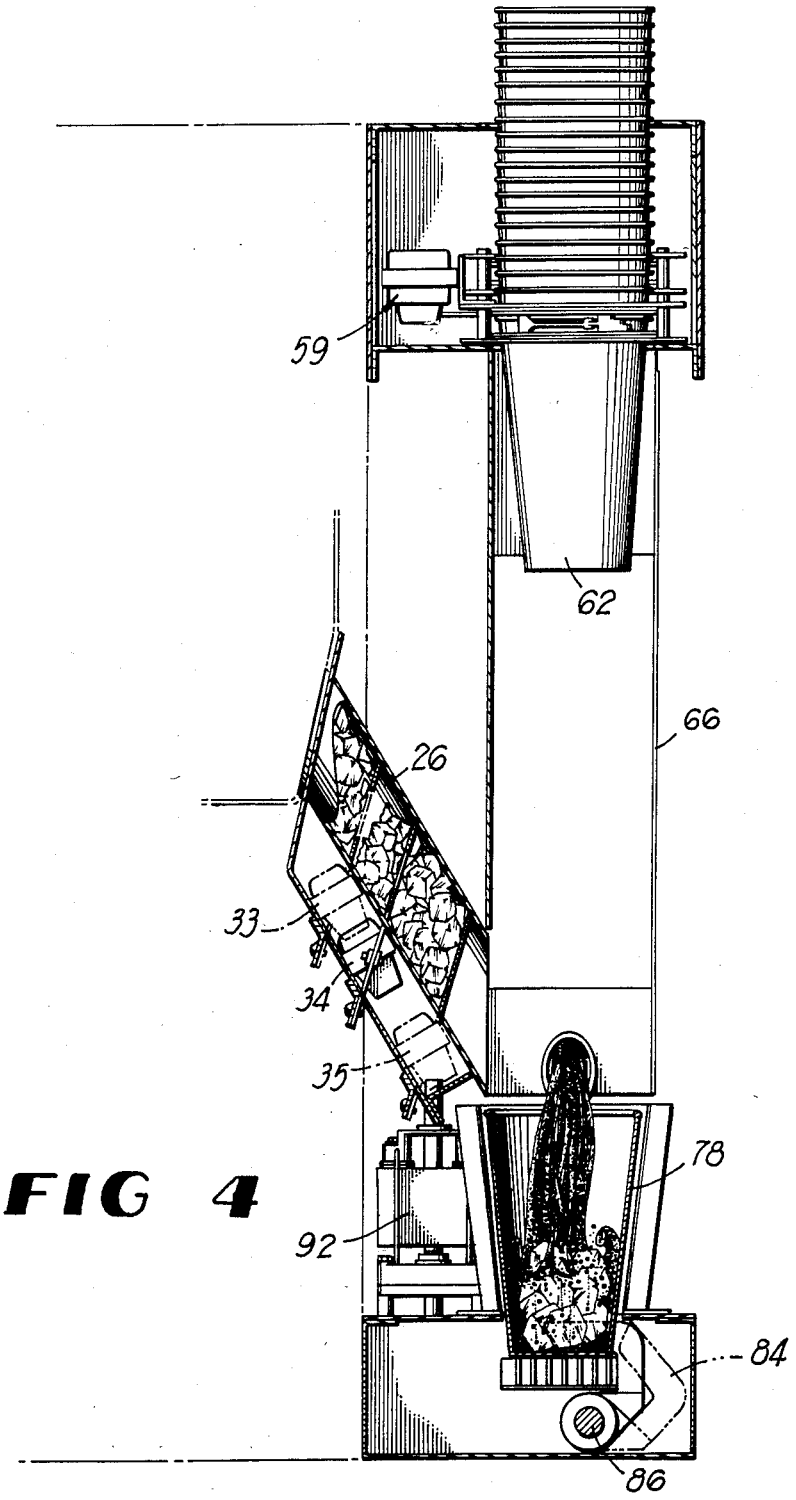
FIG. 4 is a partly cross-sectional, elevational view through the modular assembly of FIG. 3 taken along lines 4—4 thereof.

As shown in FIG. 3, the second subassembly 42 has a cup sensor 100 at the cup dropping station. The sensor 100 includes a light source and a sensor to receive reflected light from a cup if present at the cup dropping station. The sensor 100 generates a signal which is sent to a processor 102. The processor 102 is preferably a microprocessor which is part of a control circuit mounted behind the button arrangement on the front of the cover 58. The control circuit controls the filling of the cup 78 with ice and beverage, and runs the conveyor to move the filled cup forward.

A second cup sensor 104 is located at the operator station 82 to detect the presence of a cup. The sensor 104 also includes a light source and a sensor to receive reflected light from the surface of the cup. If a cup is present at the operator station, the control circuit will now allow the modular assembly 14 to again be operated until such cup has been removed.

Figure 14:
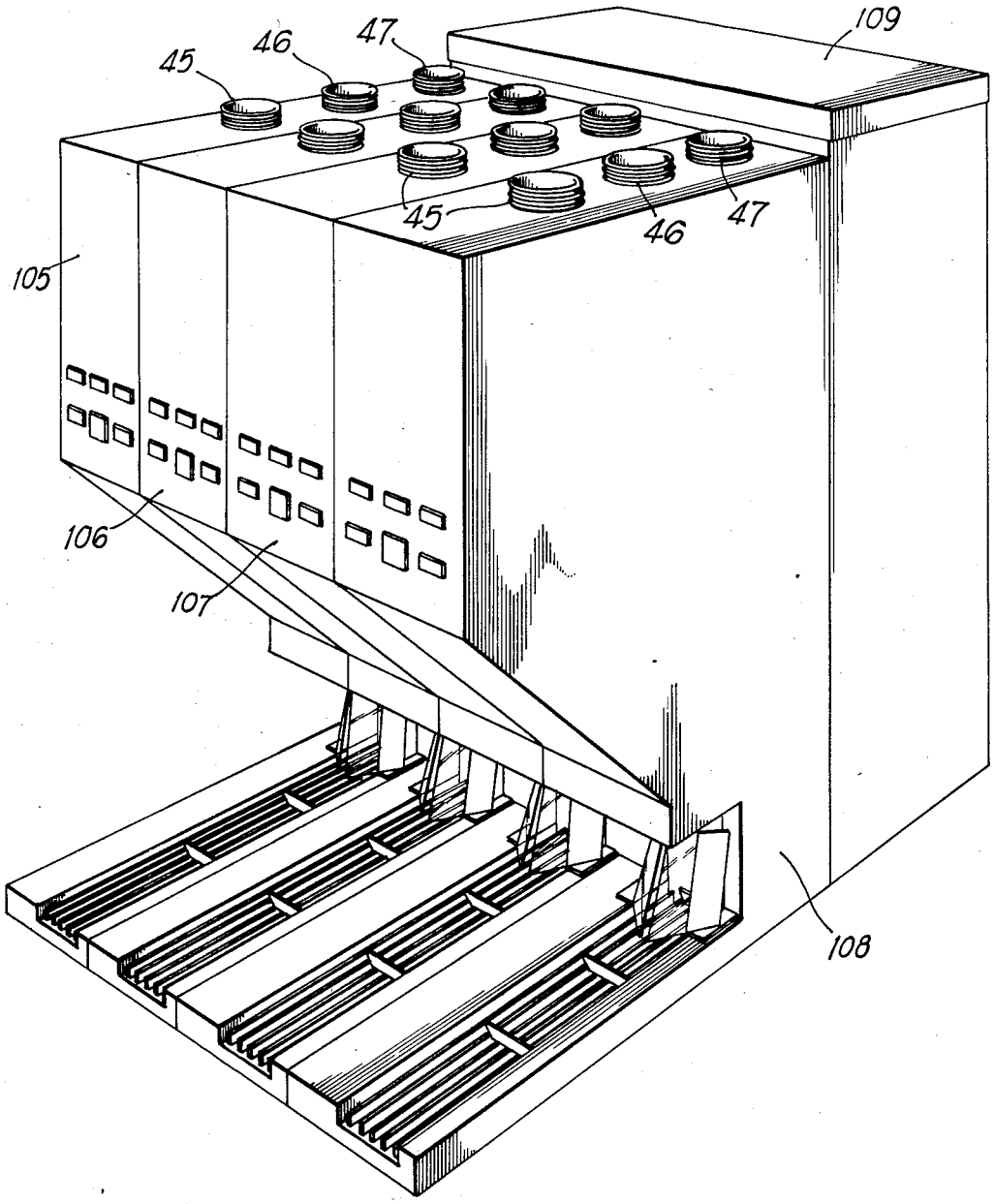
FIG. 14 is a pespective view of another embodiment of the present invention showing a plurality of modular assemblies side by side.

FIG. 14 shows a plurality of the modular assemblies 105, 106, 107, and 108 arranged side by side and connected at their rear surfaces to an ice dispenser 109. For post-mix use, the ice dispenser 109 may also include a carbonator.

Figure 15:
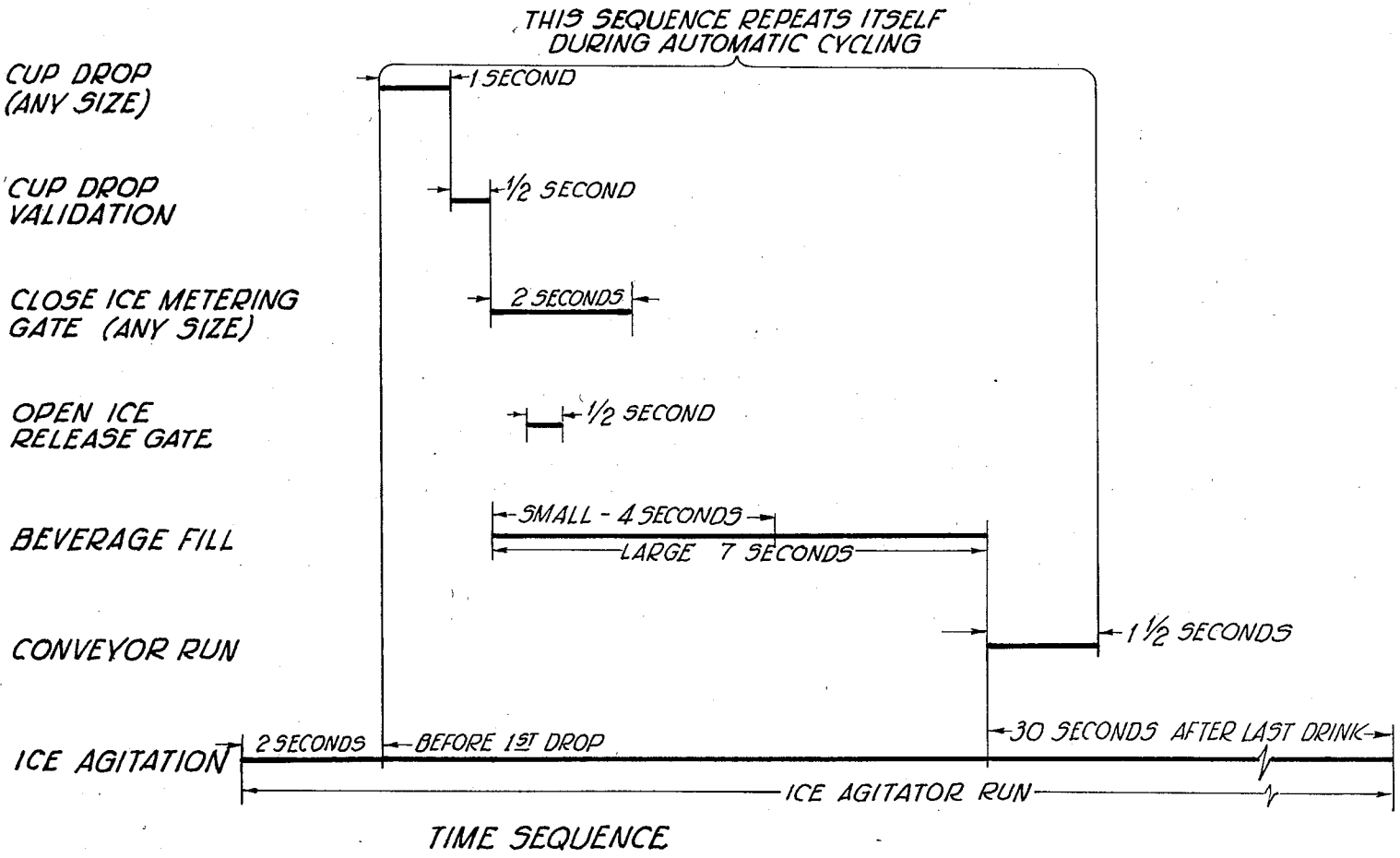
FIG. 15 is a timing diagram showing the operation of the modular assembly of the present invention.

FIG. 15 shows the time sequence which repeats itself during the automatic cycling of the modular assembly. As will be seen from FIG. 15 and from the above description of the modular assembly 14, the sequence of events is as follows: (1) the automatic cup dropper 44 drops a cup; (2) the presence of the cup in the cup dropping station 67 is validated by the cup sensor 100; (3) the automatic ice dispenser 24 then dispenses either a small or a large quantity of ice into the cup, depending upon whether the particular drink ordered was a small or a large size, by first closing the proper metering gate or stop member 30 or 31 and by then opening the release gate or stop member 32, (4) the beverage dispensing valve assembly 48 then dispenses the beverage for a predetermined period of time depending upon whether a particular drink ordered is a small or a large size, the time being four seconds for a small and seven seconds for a large; (5) the automatic conveyor is then operated for one cycle to move the filled cup forward one position, where it can be picked up by the operator; and (6) the ice agitator (not shown) is preferably operated for the time periods shown in FIG. 15. If another drink is ordered before the above-mentioned drink has been picked up, then after the next drink is made both filled cups will be moved forward along the conveyor surface 80 until a cup is present at the operator station 82, at which time no further drinks will be made until such cup is removed.

Any one of a number of control circuits can be used to achieve the automated control of the modular assembly 14. Because no part of the present invention involves the specific control circuitry used and because it is well within the skill of the art to provide the straightforward control circuitry, a specific control circuit need not and should not be described in detail.

Figure 16:
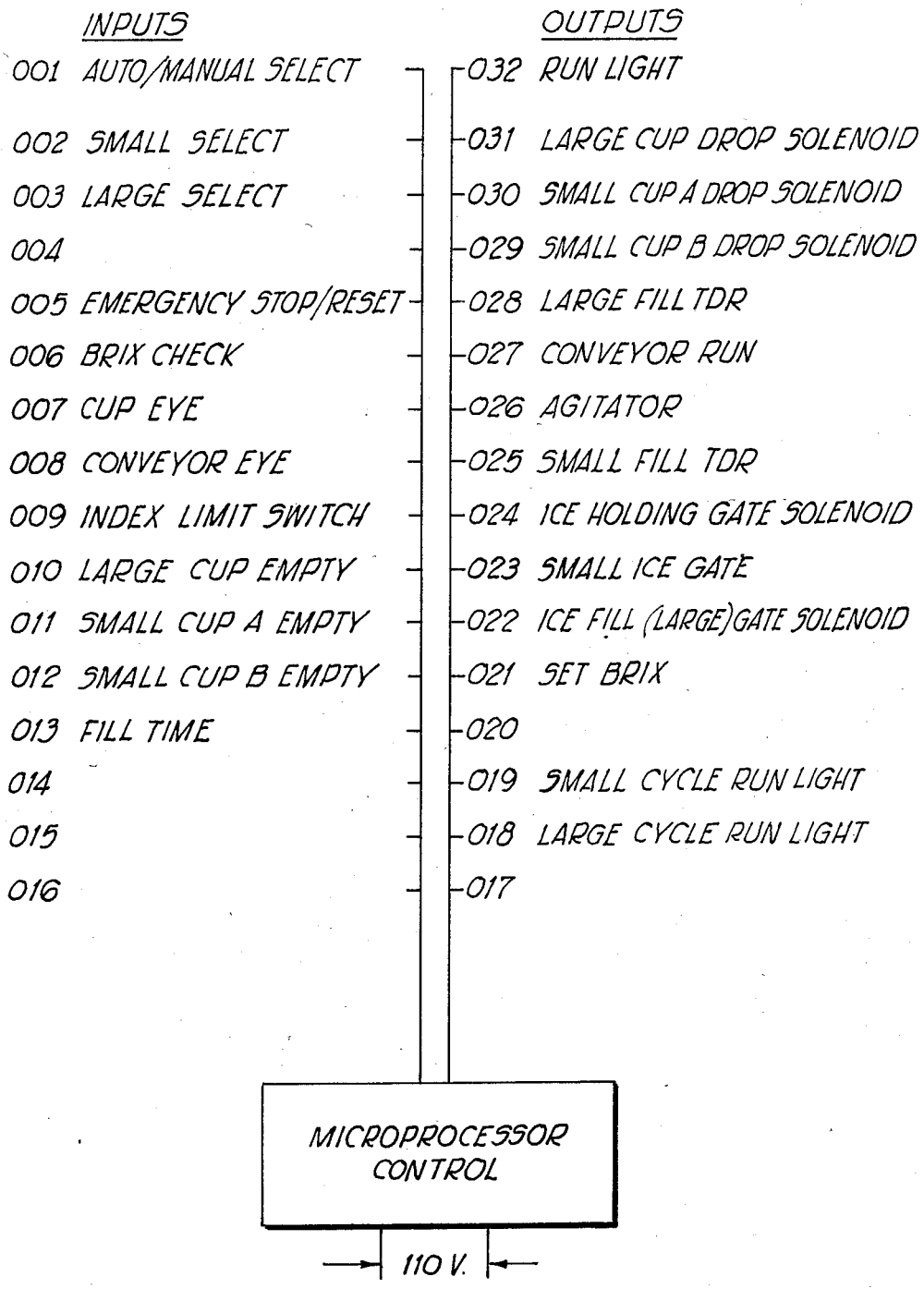
FIGS. 16 and 17 are input-output wiring diagrams.
Figure 17:
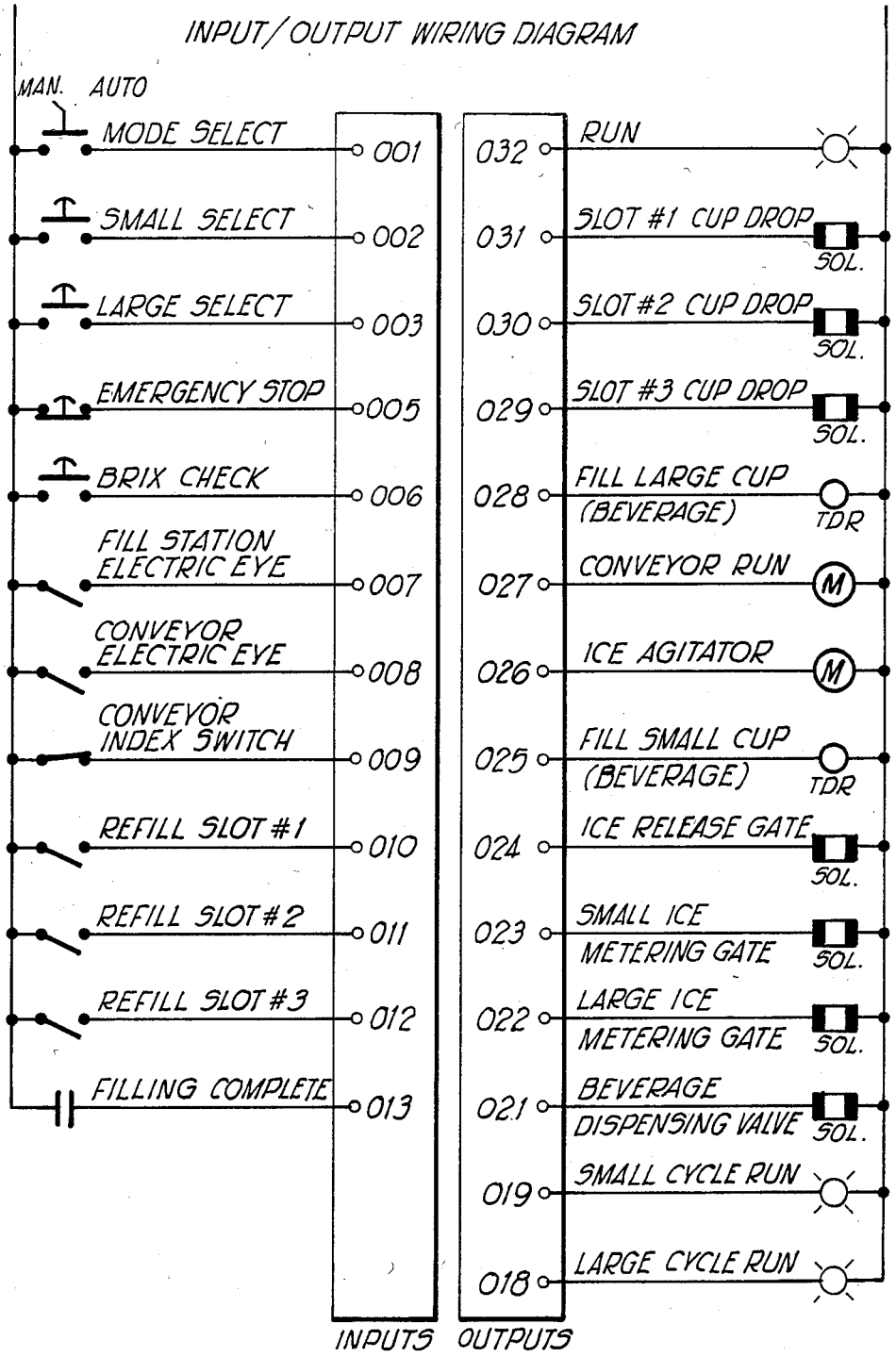

However, briefly, FIGS. 16 and 17 are input and output diagrams used in one preferred embodiment with a particular processor control. The particular processor used was a modular automation controller by Allen-Bradley which is described in Allen-Bradley's User's Manual bulletin 1742, Cat. No. 1742-UM, May, 1983.

While the preferred embodiment of this invention has been described above in detail, it is to be understood that variations and modifications can be made therein without departing from the spirit and scope of the present invention as set forth in the appended claims. For example, other conveyors can be used, such as chain, belt, or other types. In the preferred embodiment, the filling of the beverage is controlled by time, however, it can alternatively be controlled by measuring the weight of the cup as it is being filled or by ultrasonic level detecting means, for example. The ice can be fed into the cup, and the beverage can be fed into the cup at different locations, if desired. While a single flavor valve is shown, a multi-flavor valve can be used to automatically dispense various different beverages. While only two cup sizes are shown, more or fewer can be used. The modular assembly can be used on one side only of a beverage dispenser or alternatively on two or three sides. Also, more than one modular assembly can be connected to any one side, preferably by having the modular assembly extend away from the beverage dispenser rather than alongside of it. In such case, the ice can come in from the rear rather than into the side of the modular assembly, and the valve assembly can then be at the front rather than at the rear end. Further, more than one valve assembly can be used, if desired, to dispense different beverages, for example.

While it is preferred to use the modular assembly in combination with and connected to a beverage dispenser with a manual ice dispenser and a plurality of valve assemblies, it is not essential that any valve assemblies be included on the ice dispenser to which the modular assembly is to be attached. The modular assembly is shown for use with post-mix; however, it can also be used for pre-mix beverages.

The beverage dispensing valve assembly 48 can be attached to the first subassembly with the cup dropper rather than to the second subassembly with the conveyor. Further, it is not essential that the modular assembly have two separate subassemblies; it can alternatively be only a single unit, or it can have three separate subassemblies, if desired.

I claim:

1. An automatic beverage dispensing apparatus comprising:

(a) a narrow, modular assembly having a height and a depth substantially greater than its width, and having a uniform width along the entire height and depth thereof, said assembly including a cup dropping station, a beverage filling station, and conveyor means for moving a beverage-filled cup away from said beverage filling station;

(b) said conveyor means including a flat, narrow, horizontal surface located adjacent a lower portion of said assembly and extending from said cup dropping station to an operator station at a front end of said modular assembly, said surface being adapted to receive and support a cup dropped thereon while said cup is filled with a beverage and is then moved away from said beverage filling station; said conveyor means including means for automatically moving a cup on said surface from said cup dropping station to said operator station;

(c) said assembly including means for automatically dropping a cup onto said surface at said cup dropping station, said cup dropping means including cup holding means located adjacent an upper portion of said assembly, and also including a cup chute located below said cup holding means for guiding a dropped cup onto said surface in an upright condition;

(d) said assembly including means for automatically dispensing a beverage into a cup on said surface at said beverage dispensing station; and (e) said cup chute including an opening extending through a vertical wall thereof and located above a cup dropped onto said surface at said cup dropping station, whereby ice can be dispensed through said opening and into a cup located on said surface in said cup dropping station.

2. The apparatus as recited in claim 1 wherein said surface of said conveyor means is stationary and including shuttle means for pushing cups along said surface.

3. The apparatus as recited in claim 2 wherein said shuttle means includes a plurality of equally spaced apart transverse push arms mounted for reciprocating movement with respect to said surface including a push stroke and a return stroke, said arms being positioned on top of said surface during said push stroke, and means for retracting said push arms away from said surface during said return stroke.

4. The apparatus as recited in claim 3 wherein said surface comprises a plurality of thin, spaced-apart ribs extending longitudinally of said surface.

5. The apparatus as recited in claim 3 wherein said arms are all connected to an elongated, reciprocatable rod, mounted for limited rotational movement about its axis, said rod having a cam follower extending transversely therefrom, a stationary cam located adjacent to said rod and to said cam follower for causing said rod to rotate at the end of the push stroke to retract said arms away from said surface during the return stroke.

6. The apparatus as recited in claim 1 wherein said cup dropping station includes means for holding a plurality of different sized cups.

7. The apparatus as recited in claim 1 including means for detecting the presence of a cup dropped onto said surface at said cup dropping station.

8. The apparatus as recited in claim 7 wherein said detecting means comprises a light source and a light sensor for sensing light reflected from a dropped cup.

9. The apparatus as recited in claim 1 wherein said beverage dispensing means comprises a single beverage dispensing valve assembly located adjacent the bottom of said cup chute and having a nozzle oriented at an angle to the vertical and having a nozzle opening oriented in a vertical plane just inside of the wall of said cup chute.

10. The apparatus as recited in claim 1 wherein said valve assembly is a multi-flavor valve assembly.

11. The apparatus as recited in claim 10 wherein said beverage dispensing means comprises a single beverage dispensing valve assembly located adjacent the bottom of said cup chute and having a nozzle oriented at an angle to the vertical and having a nozzle opening oriented in a vertical plane just inside of the wall of said cup chute.

12. The apparatus as recited in claim 1 wherein said valve assembly is a multi-flavor valve assembly.

13. The apparatus as recited in claim 1 including in combination therewith an ice dispenser including means for automatically dispensing a predetermined quantity of ice into a cup dropped onto said surface at said cup dropping station, said ice dispensing means including an ice chute having a discharge opening extending through said cup chute opening.

14. The apparatus as recited in claim 13 wherein said assembly is attached to said ice dispenser.

15. The apparatus as recited in claim 14 wherein said ice dispensing means comprises means for dispensing a plurality of different, predetermined quantities of ice.

16. The apparatus as recited in claim 15 wherein said ice dispensing means includes an ice chute and a plurality of spaced-apart stop members movable into and out of said ice chute to control the quantity of ice dispensed therefrom.

17. The apparatus as recited in claim 16 including a solenoid connected to each of said stop members.

18. The apparatus as recited in claim 13 wherein said cup dropping station includes means for holding a plurality of different sized cups and wherein said ice dispensing means comprises means for dispensing a plurality of different, predetermined quantities of ice.

19. The apparatus as recited in claim 18 including means for detecting the presence of a cup dropped onto said surface at said cup dropping station.

20. The apparatus as recited in claim 19 wherein said beverage dispensing means comprises a single beverage dispensing valve assembly located adjacent the bottom of said cup chute and having a nozzle oriented at an angle to the vertical and having a nozzle opening oriented in a vertical plane just inside of the wall of said cup chute.

21. The apparatus as recited in claim 19 wherein said valve assembly is a multi-flavor valve assembly.

22. The apparatus as recited in claim 19 wherein said valve assembly is oriented at an angle to the vertical and is mounted on said conveyor.

23. The apparatus as recited in claim 22 wherein said beverage dispensing means comprises a single beverage dispensing valve assembly located adjacent the bottom of said cup chute and having a nozzle oriented at an angle to the vertical and having a nozzle opening oriented in a vertical plane just inside of the wall of said cup chute, wherein said surface of said conveyor means is stationary and including shuttle means for pushing cups along said surface.

24. An automatic beverage dispensing apparatus comprising:

(a) a narrow, modular assembly having a height and a depth substantially greater than its width, and having a uniform width along the entire height and depth thereof, said width being less than about ten inches, said assembly including first and second separate subassemblies, said first subassembly including a cup dropping station, and said second subassembly including a beverage filling station and conveyor means for moving an ice-filled and beverage-filled cup to an operator station at a front end of said modular assembly;

(b) said conveyor means including a flat, narrow, horizontal surface located adjacent a lower portion of said assembly and extending from said cup dropping station to said operator station, said surface being adapted to receive and support a cup dropped thereon while said cup is sequentially filled with ice, then filled with a beverage, and then moved to said operator station, said conveyor means including means for automatically moving a cup on said surface from said cup dropping station to said operator station;

(c) said first subassembly including means for automatically dropping a cup onto said surface at said cup dropping station, said cup dropping means including cup holding means located adjacent an upper portion of said assembly and a cup chute located below said cup holding means for guiding a dropped cup onto said surface in an upright condition;

(d) said second subassembly also including means for automatically dispensing a beverage into a cup located at said beverage dispensing station; and (e) said cup chute including an opening extending through a vertical wall thereof and located above a cup dropped onto said surface at said cup dropping station, whereby ice can be dispensed through said opening and into a cup located on said surface in said cup dropping station.

25. The apparatus as recited in claim 24 including in combination therewith an ice dispenser including means for automatically dispensing a predetermined quantity of ice into a cup dropped onto said surface at said cup dropping station, said ice dispensing means including an ice chute having a discharge opening extending through said cup chute opening.

26. The apparatus as recited in claim 25 wherein said ice dispenser is an ice dispensing beverage dispenser having a plurality of valve assemblies.

27. The apparatus as recited in claim 26 wherein said beverage dispenser includes one of said ice dispensers in each sidewall thereof and including a separate modular assembly connected to each side of said beverage dispenser.

28. A method for automatically dispensing a beverage comprising the steps of:

(a) modifying a beverage dispenser of the type having a plurality of beverage dispensing valve assemblies and an ice dispenser by adding thereto an ice dispensing chute extending from a side wall thereof and means for automatically dispensing ice from said chute; and (b) attaching to said side wall a narrow, automatic beverage dispensing modular assembly having a height and depth substantially greater than its width, said modular assembly including:

(i) means for automatically dropping a cup onto said conveyor means at a cup dropping station;

(ii) means for dispensing ice into said cup from said ice dispensing means;

(iii) means for dispensing a beverage into said ice filled cup; and (iv) conveyor means for moving an ice-filled and beverage-filled cup from said cup dropping station to an operator station at a front end of said modular assembly.

29. The method as recited in claim 28 wherein said modifying step comprises adding an ice chute extending from both side walls of said beverage dispenser and wherein said attaching step comprises attaching one of said modular assemblies to each of said side walls.

30. The method as recited in claim 28 including sensing the presence of a cup dropped onto said conveyor at said cup dropping station and dispensing ice into said cup after a "cup present" signal has been received by said sensing step.

31. The method as recited in claim 28 including sensing the presence of a cup on said conveyor means at said operator station and inactivating said apparatus if a cup is present at such distal end.

* * * * *